US008733880B2

(12) United States Patent
Izawa et al.

(10) Patent No.: US 8,733,880 B2
(45) Date of Patent: May 27, 2014

(54) DIGITAL PRINTING METHOD AND AN APPARATUS THEREFOR

(71) Applicant: Miyakoshi Printing Machinery Co., Ltd., Narashino (JP)

(72) Inventors: Hideo Izawa, Narashino (JP); Yuuichi Yamazaki, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 4 days.

(21) Appl. No.: 13/708,108

(22) Filed: Dec. 7, 2012

(65) Prior Publication Data

US 2013/0155131 A1 Jun. 20, 2013

(30) Foreign Application Priority Data

Dec. 14, 2011 (JP) ..... 2011-272932

(51) Int. Cl.

| | |
|---|---|
| ***B41J 11/46*** | (2006.01) |
| ***B41J 11/24*** | (2006.01) |
| ***B41J 15/00*** | (2006.01) |
| *B41J 11/00* | (2006.01) |

(52) U.S. Cl.

CPC ..... *B41J 11/46* (2013.01); *B41J 15/005* (2013.01); *B41J 11/24* (2013.01); *B41J 11/008* (2013.01)

USPC ..... 347/16; 271/9.1

(58) Field of Classification Search

CPC ..... B41J 11/46; B41J 11/42

See application file for complete search history.

(56) References Cited

U.S. PATENT DOCUMENTS

| | | | | |
|---|---|---|---|---|
| 5,008,710 | A * | 4/1991 | Kobayashi et al. | 399/317 |
| 5,631,692 | A * | 5/1997 | Maruyama | 347/262 |
| 2007/0222805 | A1 * | 9/2007 | Moscato et al. | 347/12 |
| 2012/0242735 | A1 * | 9/2012 | Izawa et al. | 347/16 |

FOREIGN PATENT DOCUMENTS

JP 2005-335145 A 12/2005

* cited by examiner

*Primary Examiner* — Shelby Fidler

(74) *Attorney, Agent, or Firm* — Westerman, Hattori, Daniels & Adrian, LLP

(57) ABSTRACT

A digital printing method includes printing timing marks for each of images; in reprinting after printing is temporarily suspended, feeding a web of paper to travel backwards so that a plurality of images and timing marks printed thereon before printing is temporarily suspended move towards upstream of a digital printer and thereafter feeding the web of paper to travel forwards again, and counting by mark sensors, upstream of the digital printer, the number of such timing marks moving in each of the backward feed and forward re-feed of the web of paper; and when the number of counts of the timing marks counted in the forward re-feed coincides with the number of counts of the timing marks counted in the backward feed, reinitiating to print consecutive images from a position following an image last printed before printing is temporarily suspended.

5 Claims, 4 Drawing Sheets

DIGITAL PRINTING METHOD AND AN APPARATUS THEREFOR

TECHNICAL FIELD

The present invention relates to a digital printing method and an apparatus therefor using a digital printer or printing press such as an ink jet printer or electrophotographic printer, by which images each for one page are printed consecutively on a traveling web of paper for rotary press, and in which a printing operation after it is temporarily suspended en route is reinitiated.

BACKGROUND ART

In a printing method and apparatus of this sort as in a conventional system of rotary printing, e.g., as shown in JP 2005-335145 A, a web of paper for rotary press being printed on by an ink jet printer is fed to travel at an established speed in one direction from a paper feed unit to a paper takeup unit.

In the printing method and apparatus of this sort, it has hitherto been the case that for a variety of reasons such as of ending of printing data, printing data being divided for each of a number of the small number of prints, machine adjustments, checking of a printing state and operational convenience, there may en route be temporary halts or suspensions of printing from a continuous printing operation, the printing operation being subsequently reinitiated.

In the process in which a web of paper in the course of printing is fed to travel at a fixed speed as mentioned above, the web of paper, when the printing is suspended, still travels over a certain distance, leaving a blank portion due to inertia of the printing apparatus. And, when printing is reinitiated, the printing operation is initiated on a portion of paper following the blank portion of paper which has traveled over that distance after printing is temporarily suspended en route, with the result that such blank portions become mixed as NG portions of printed paper in a paper takeup roll downstream in the printing system.

Consequently, in the conventional digital printing method and apparatus of this sort the problem has come up that if a printing operation after it is temporarily suspended en route is reinitiated, in a tail end process of a printed paper takeup roll, the steps of processing NG portions of printed paper become complicated and troublesome. Moreover, noting that a printing speed exceeding 200 m/min is available in the latest printing process, the problem has arisen that a blank portion of printed paper produced when printing is suspended temporarily en route becomes elongated, thereby giving rise to an increase in the amount of broke or waste of paper.

Further, the conventional printing method and apparatus mentioned above has also entailed a problem that an increased force is caused to act on the web of paper both at a time it is brought to a temporary halt and at a time it is driven to initiate traveling.

In view of the foregoing problems, it is an object of the present invention to provide a digital printing method as well as an apparatus therefor which, if a consecutive printing operation after it is suspended temporarily en route is reinitiated, is capable of printing without producing waste of paper due to a portion left blank on a web of paper for rotary press and which is capable of so printing without causing an increased force to act on the web of paper both at a time it is brought to a temporary halt and at a time it is driven to initiate traveling.

DISCLOSURE OF THE INVENTION

In order to achieve the objection mentioned above, there is provided in accordance with the present invention a digital printing method using a digital printer by which images each for one page are consecutively printed on a web of paper for rotary press fed to travel forwards, and in which after printing is suspended temporarily en route, printing is reinitiated on the web of paper fed again to travel forwards, wherein the method comprises the steps of: printing the images and timing marks each for the image with the digital printer while the web of paper is being fed to travel forwards from a paper feed unit to a paper takeup unit with a pair of paper feed roll units which are positioned upstream and downstream, respectively, of the digital printer in a direction of forward feed of the web of paper and which are made able to feed the web of paper to travel both forwards and backwards; in reinitiation of printing after printing is temporarily suspended en route, feeding the web of paper to travel backwards so that a series of images and timing marks printed thereon before printing is temporarily suspended moves towards upstream of the digital printer and thereafter feeding the web of paper to travel forwards again, and counting by a mark sensor, upstream of the digital counter, the number of such timing marks moving in each of the backward feed and forward re-feed of the web of paper, respectively; when the number of counts of the timing marks counted in the forward re-feed coincides with the number of counts of the timing marks counted in the backward feed, reinitiating to print consecutive images from a position following an image last printed before printing is temporarily suspended; and rendering the paper feed unit able to feed the web of paper to travel exclusively forwards while it is being braked, wherein when the web of paper is fed to travel backwards as aforementioned, the web of paper upstream of the upstream side paper feed roll unit is brought back to and stored in a buffer unit having a paper path whose length is made variable.

In the digital printing method mentioned above, a distance of travel of the web of paper upstream of the digital counter may be detected by a travel distance detector, and a position to reinitiate printing when the number of counts of the timing marks counted in the forward re-feed coincides with the number of counts of the timing marks counted in the backward feed, is determined from a detection value by the travel distance detector.

The present invention also provides a digital printing apparatus for carrying out a digital printing method as mentioned above, wherein the apparatus comprises: a digital printer for printing images each for one page consecutively and timing marks each for the image on a web of paper for rotary press fed to travel forwards; an upstream and a downstream side paper feed roll unit positioned upstream and downstream, respectively, of the digital printer in a direction of forward feed of the web of paper, the paper feed roll units being operable synchronously with each other to feed and re-feed the web of paper to travel forwards in printing thereon and to feed the web of paper to travel backwards after printing is temporarily suspended; a paper feed unit positioned upstream of the upstream paper feed roll unit and adapted to feed the web of paper to travel exclusively forwards while it is being braked; a paper takeup unit provided downstream of the downstream side paper feed roll unit and adapted to rotate forwards and backwards in conjunction with operations of both the paper feed roll units; a buffer unit provided between the paper feed unit and the upstream side paper feed roll unit and in which is brought back to and stored a backward feed length of the web of paper fed to travel backwards from the paper feed roll units after printing is temporarily suspended and from which subsequently in its forward re-feed the length of web of paper so stored is paid out to travel forwards; a mark sensor positioned upstream of the digital printer in a direction of the forward feed for counting the number of the timing marks in backward feed after printing is temporarily suspended and counting the number of the timing marks in the subsequent forward re-feed; and a control unit furnished with a number of counts from the mark sensor in the backward feed after printing is temporarily suspended and a number of counts from the mark sensor in its subsequent forward re-feed and operable, when the number of counts of the timing marks counted in the forward re-feed coincides with the number of counts of the timing marks counted in the backward feed, for providing the digital printer with a signal commanding to reinitiate printing consecutive images from a position following an image last printed before printing is suspended.

An the buffer unit may comprise: a fixed frame provided with an upper roller row having a plurality of guide rollers arranged in a direction of travel of the web of paper, an elevating frame positioned under the fixed frame and capable of being moved up and down, the elevating frame being provided with a lower roller row having a plurality of guide rollers arranged in a direction of travel of the web of paper so as to correspond to those of the upper roller row, and an elevating unit for moving the elevating frame up and down, whereby the elevating frame is moved up and down to change a length of path through which the web of paper is passed between the upper and lower roller row.

Further, in the digital printing apparatus for the digital printing method mentioned above, upstream of the digital printer there may be provided a travel distance detector for detecting a distance of travel of the web of paper, the control unit being adapted to receive detection values by the travel distance detector and detection values by the mark sensor for determining from a signal from the travel distance detector a position to reinitiate printing when the number of counts of the timing marks counted in the forward re-feed coincides with the number of counts of the timing marks counted in the backward feed.

The digital printing method according to the present invention allows printing with a digital printer without producing a portion left blank if printing is suspended en route and thereafter reinitiated.

In a printing operation using a digital printer, it has hitherto been the case that for a variety of reasons of, e.g., ending of printing data, printing data being divided for each of a number of the small number of prints, machine adjustments, checking of a printing state and operational convenience, there may be circumstances in which the printing process must en route be temporarily halted or suspended from its continuous operation. According to the proposed method which, if a printing operation after it is temporarily halted is reinitiated, allows reinitiating to print consecutive images from a position which immediately follows an image last printed thereon when printing is temporarily suspended, the possibility can be eliminated of yielding a paper product which, with a blank or unprinted paper portion or portions, fails to become a satisfactory product and is then processed. It follows, therefore, that the yield rate of printed webs of paper for rotary press is improved.

Also, where portions failing to become satisfactory products are mixed in a web of paper taken up in a takeup roll in the paper takeup unit, while removing those portions as then made necessary has hitherto required an operation in a number of steps of the tail end process, this problem is resolved by the proposed method, which thus rises the efficiency of operation.

Further, where portions failing to become satisfactory products are mixed in a printed web of paper taken up in a takeup roll as mentioned above, while the tail end process of processing them has hitherto been complicated, tending to bring about a mixing of NG paper portions and a failure in operation for sorting them in the production control and giving rise further to the problem of involving useless works deemed necessary to prevent such failures, a web of paper as printed on and taken up according to the proposed method can, as it is, constitute a product that has been continuously printed and can as a whole be continuously processed in the tail end process, thus sharply rising the efficiency of production of products.

According to the aforementioned digital printing method and apparatus for carrying out the method in accordance with the present invention in which the paper feed unit is adapted to operate exclusively feeding a web of paper and the web of paper fed to travel backwards towards upstream of the upstream paper feed unit in the step of backward feed is brought back to and stored in the buffer unit and in its subsequent step of forward re-feed the web of paper is paid out and fed from the buffer unit, it is to be noted that processing of the web of paper upstream of the upstream roll unit in both a backward feed and its subsequent forward re-feed can be effected without causing an increased force to act on the web of paper.

Since a total length of the web of paper fed to travel backwards in the backward feed is brought back to and stored in the buffer unit and printing is reinitiated when the total stored length of web of paper has been paid out to travel forwards in the subsequent forward feed, reprinting can be initiated in the state that the web of paper brought back to and stored runs out, thereby making it possible to reinitiate printing in a stabilized state.

BEST MODES FOR CARRYING OUT THE INVENTION

Figure 1:
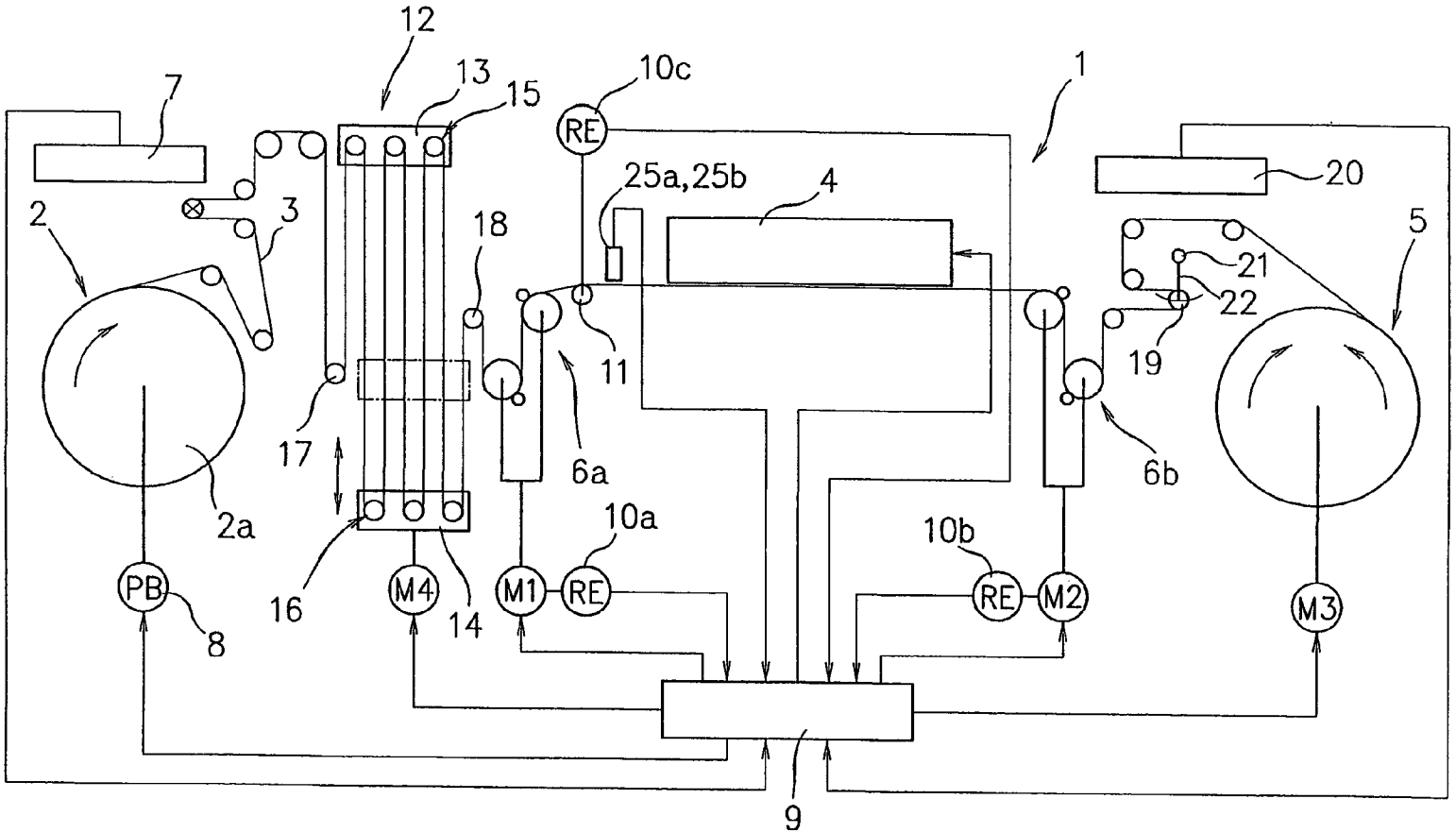
FIG. 1 is an explanatory view diagrammatically illustrating the makeup of a digital printing apparatus according to the present invention.

FIG. 1 shows a digital printing apparatus 1 according to the present invention. The digital printing apparatus 1 has its basic makeup in which a web of paper 3 for rotary press fed from a paper feed unit 2 is printed by an ink jet printer 4 as an example of a digital printing press and then taken up by a paper takeup unit 5. The web of paper 3 for rotary press is here designed to be fed to travel forwards, i.e., from the paper feed unit 2 towards the paper takeup unit 5, and also to travel backwards, i.e., from the paper takeup unit 5 towards the paper feed unit 2.

Upstream and downstream of the ink jet printer 4 in the direction of forward travel of the web of paper 3 there are provided paper feed roll units 6*a* and 6*b* driven controllably to rotate both normally and reversely independently by drive motors M1 and M2, respectively. By causing the paper feed roll units 6*a* and 6*b* to be driven controllably to rotate normally and reversely singly by drive motors M1 and M2, respectively, the web of paper 3 for rotary press can be fed to travel forwards, i.e., from the paper feed unit 2 towards the paper takeup unit 5 and to travel backwards, i.e., from the paper takeup unit 5 towards the paper feed unit 2.

Here, the motors M1 and M1 for the paper feed roll units 6*a* and 6*b* when driven to feed the web of paper 3 to travel both forwards and backwards are controlled in rotation so as to ensure that the rate of feed of the web of paper 3 by the paper feed roll unit then switched to lie downstream is made slightly higher than that of the web of paper 3 by the paper feed roll then switched to lie upstream whereby the web of paper 3 traveling beneath the ink jet printer 4 has a normal tension applied thereto.

The paper takeup unit 5 is driven by a motor M3 so that it can rotate in both the normal and the reverse directions. The paper takeup unit 5 is designed to both takeup and pay out the web of paper 3 in accordance with the rates of forward and backward feed of the web of paper 3 by the paper feed roll units 6*a* and 6*b*, respectively.

On the other hand, a paper feed roll 2*a* in the paper feed unit 2 is made able to rotate only in the paper feed direction (forward feed direction). The paper feed roll 2*a* is designed to rotate in the forward feed direction while being braked by a tension control unit 7 and a powder brake 8.

The motors M1, M2 and M3 are controlled in rotation by a control unit 9. And, encoders 10*a* and 10*b* are provided to detect rotations of the motors M1 and M2 that drive the paper feed roll units 6*a* and 6*b*, respective values of their detection being fed back to the control unit 9.

Also, upstream of the ink jet printer 4 there is provided a free roll 11 rotating to follow travel of the web of paper 3. The rotation of the free roll 11 is detected as a distance of travel of the web of paper 3 by an encoder 10*c* and a value detected by it is fed back to the control unit 9, wherein the free roll 11 and the encoder 10*c* detecting its rate of rotation constitute a travel distance detector for detecting a distance of travel of the web of paper 3.

In the form of implementation of the invention illustrated in FIG. 1, between the paper feed unit 2 and the paper feed roll unit 6*a* on its side there is provided a buffer unit 12 for storing the web of paper 3 over a selected length which is made adjustable.

The buffer unit 12 has a fixed frame 13 and an elevating frame 14 which is opposed to the fixed frame 13 from its lower side and mounted as capable of being moved up and down. The fixed frame 13 is provided with an upper roller row 15 comprising a row of guide rolls arranged in a direction of travel of the web of paper 3 (in a horizontal direction), whereas the elevating frame 14 is provided with a lower roller row 16 comprising a row of guide rolls arranged in a direaction of travel of the web of paper 3 so as to oppose to the upper roller row 15.

The buffer unit 12 is provided at its upstream side with an inlet side guide roller 17 and at its downstream side with an outlet side guide roller 18, which are supported by their respective support frame (not shown). The web of paper 3 from the paper feed unit 2 is introduced into the buffer unit 12 via the inlet side guide roller 17 and is wound on rollers of the upper roller row 15 and rollers of the lower roller row 16 by one by one by turns, whereby they constitute a buffer path. The web of paper 3 from the buffer path is passed via the outlet side guide roller 18 into the paper feed roll unit 6*a* on the upstream side.

The elevating frame 14 of the buffer unit 12 is moved up and down by an elevating unit (not shown) which is driven by an independent motor M4 that is controlled by the control unit 9 so as to be rotatable in the normal and the reverse directions.

Between the paper feed roll unit 6*b* on the downstream side and the paper takeup unit 5 there is provided a dancer roller 19 for adjusting the tension of the web of paper 3 across its traveling path on the side of the paper takeup unit 5. The tension that the dancer roll 19 imparts to the web of paper 3 is created by a displacement of the dancer roll 19 and varied as its position is varied. Positions of the dancer roll 19 at different times are detected by a dancer roll position detector 20 and signals of such detection are fed back to the control unit 9.

The dancer roll 19 is supported by the end of a rotary lever 22 having its base fixed to a dancer roller primary shaft 21, thus pivotally on the primary shaft 21. The tension which the dancer roll 19 imparts to the web of paper 3 is created by giving a selected rotation torque to the dancer roller primary shaft 21. Means for generating such a rotation torque may be by one that can be selected from a way of applying a weight to a rotary lever 22, a way of applying a fixed force from a bellofram cylinder to the rotary lever 22 and varieties of other like ways.

A displacement of the dancer roll 19 is detected by the dancer roller position detector 20 detecting a movement of the rotary lever 22, and a signal from the dancer roll position detector 20 is fed to the control unit 9. By the drive motor M3 whose driving is controlled by the control unit 9 so that the dancer roll 19 is held at a selected position, rotation of the takeup shaft of the paper takeup unit 5 is controlled, thereby maintaining constant the tension imparted to the web of paper 3.

By the makeup mentioned above, a proper tension of the web of paper 3 is maintained in each of the paper feed unit 2, the buffer unit 12, the upstream and downstream side paper feed units 6*a* and 6*b* and the paper takeup unit 5. While the tension is being so maintained, the web of paper 3 can be switched to traveling in either forward or backward direction.

Figure 2:
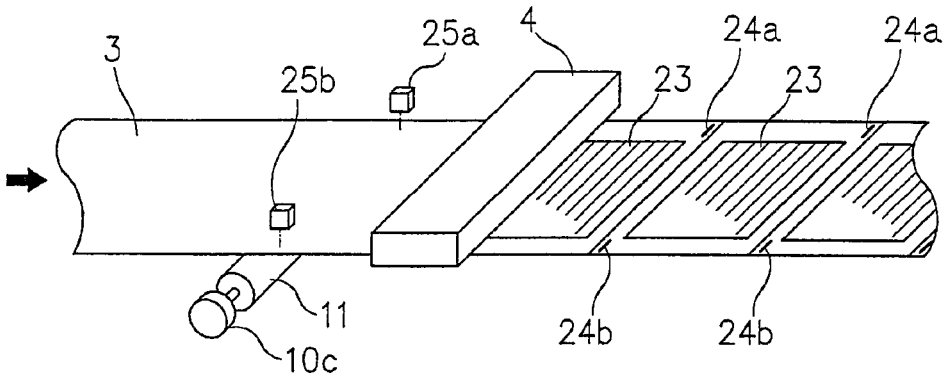
FIG. 2 is an explanatory view illustrating a state of printing by the digital printing apparatus.

By the ink jet printer 4, as shown in FIG. 2 images 23 each for one page are printed consecutively on a web of paper 3 for rotary press while the web of paper 3 is being fed forwards. And, together with an image 23, a pair of timing marks 24*a* and 24*b* are printed at a pair of positions on both sides across the width of the image 23, e.g., at its diagonally opposite positions, respectively, i.e., one at an upstream side in the direction of forward travel of the web of paper 3 and the other at a downstream side in the direction of forward travel of the web of paper 3. To detect the pair of timing marks 24*a*, 24*b*, there are provided a pair of mark sensors 25*a* and 25*b* at a pair of positions upstream of the ink jet printer 4 in the direction of forward travel of the web of paper 3, respectively, so as to be opposed to both ends of the surface of the web of paper 3 across it width.

In the makeup mentioned above, images 23 each for one page and timing marks comprising a pair of timing marks 24*a* and 24*b* together with each of the images 23 as shown in FIG. 2 are printed by the ink jet printer 4 on a surface of the web of paper 3 for rotary press while the web of paper 3 is being fed to travel forwards at a fixed speed.

To initiate printing on a web of paper 3 fed to travel forwards, the elevating frame 14 in the buffer unit 12 is driven by the fourth drive motor M4 to take its upper position. With the elevating frame 14 moved up to at the upper position, the length of the web of paper 3 stored in the buffer unit 12 can be the shortest. In printing, the web of paper 3 is fed forwards via the buffer unit 12 by paper feed action of the paper feed roll units 6*a* and 6*b*. The web of paper 3 fed from the paper feed unit 2 has then a selected tension applied thereto by the powder brake 8 and the tension control unit 7, and this state is maintained.

Figure 3:
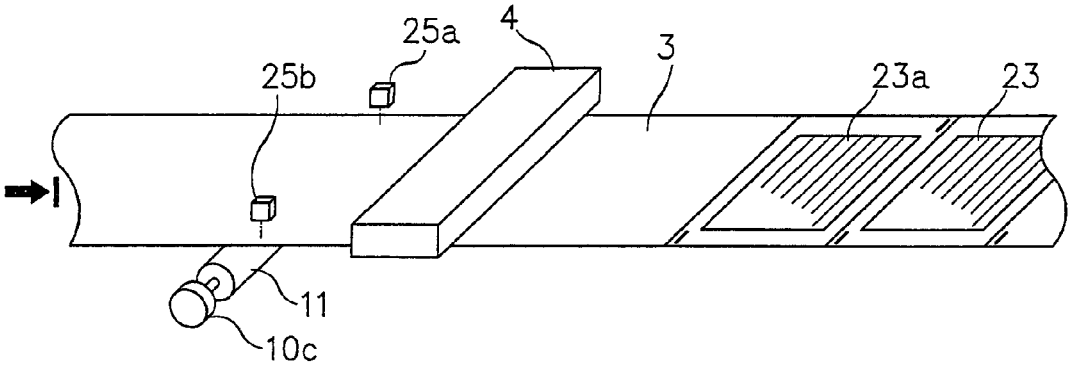
FIG. 3 is a like view illustrating a state of the printing that has been suspended.

If printing is temporarily halted in course of a continuous printing operation, at a point of time of the halt of printing the printing by the ink jet printer 4 is suspended but the web of paper 3 for rotary press is decelerated and thereafter comes to a stop. Note that the ink jet printer 4 suspends printing in the state that a last image 23*a* to be printed on the web of paper 3 is wholly printed. This state is shown in FIG. 3. The image 23*a* then last printed on the web of paper at the point of time of the halt of printing is found at a position excessively downstream of the ink jet printer 4, and the interval on paper between the last printed image 23*a* and the ink jet printer 4 is left blank over a length corresponding to a time period in which the web of paper 3 is decelerated. While the length of the blank portion is shown short, note that it amounts to a considerable length in response to a printing speed, e.g., a length of 20 m if it takes 20 seconds that the web of paper 3 traveling at a printing speed of 200 m/min comes to a halt.

In the conventional printing apparatus of this sort, printing with the ink jet printer 4 is reinitiated at this state, thus from the state shown in FIG. 3, i.e., from an upstream side of the blank portion, as a result the blank portion becomes a broke or waste of paper.

According to the digital printing apparatus of the present invention, input of a printing reinitiation signal into the control unit 9 actuates the control unit 9 to furnish the motors M1, M2, M3 and M4 with a series of control signals. The paper takeup unit 5 and the paper feed roll units 6*a* and 6*b* are reversely operated to feed the web of paper 3 to travel backwards so that the last printed image 23*a* shifts upstream of the ink jet printer 4.

The web of paper 3 then fed to travel backwards from the paper takeup unit 5 has a tension imparted thereto by the dancer roller 19 and is fed to travel backwards from the upstream side paper feed roll unit 6*a* into the buffer unit 12, maintaining the tension imparted thereto. Then in the buffer unit 12, the elevating frame 14 has been driven by the drive motor M4 to move down, lying in its lower position at which the path that the web of paper 3 passes through is lengthened in the buffer unit 12. A backward feed length of web of paper 3 which has been fed to travel backwards is brought back to and stored in the lengthened path. The lower position then of the elevating frame 14 is controlled to be a position that accords with such length of backward travel of the web of paper 3. Maintaining the tension imparted, the portion of backward travel of the web of paper 3 is brought back to and stored in the buffer unit 12. When the web of paper 3 is fed to travel backwards, the paper feed roll 2*a* of the paper feed unit 2 has a braking force acted thereon by the powder brake 8 and is thereby prevented from paying out of the paper feed unit 2.

Figure 4:
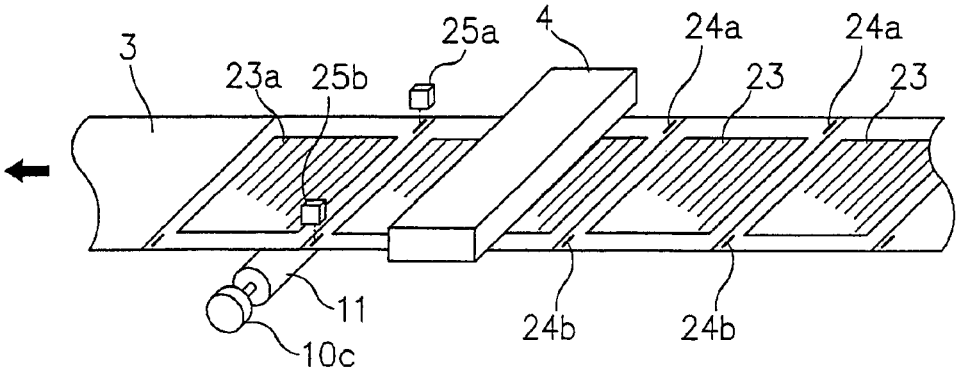
FIG. 4 is a like view illustrating a state that after printing is suspended the web of paper with portions printed thereon is fed to travel backwards.

This state of feeding the web of paper 3 backwards is shown in FIG. 4. The length of backward feed of the web of paper 3 as will be described later should be a length corresponding to a run-up length upon reinitiating forward re-feed thereafter, such that when the last printed image 23*a* passes by the ink jet printer 4, it has a normal forward speed restored. In the backward feed of the web of paper 3, while the image 23*a* printed last before the halt and its downstream images 23 pass by, and travel towards upstream of, the ink jet printer 4, the number of these printed images 23*a*, 23, 23, . . . that have passed by the ink jet printer 4 in the backward direction is counted by detecting, and counting the number of, the timing marks 24*a* and 24*b* accompanying them, respectively, by the mark sensor 25*a* and 25*b*.

Figure 5:
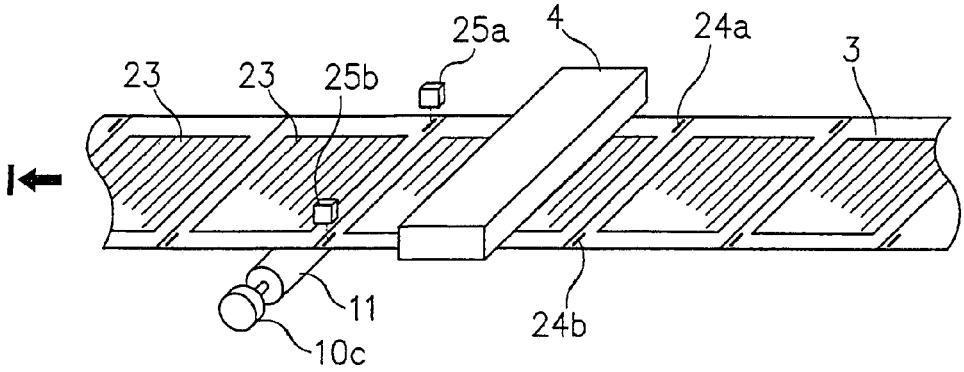
FIG. 5 is a like view illustrating a state that feeding the web of paper with printed portions to travel backwards is halted.

FIG. 5 shows the state that the backward travel of the web of paper 3 for rotary press is halted. The numbers of the timing marks 24*a* and 24*b* respectively counted by the mark sensors 25*a* and 25*b* during the backward feed are input into the control unit 7. Then, the timing marks 24*a*, 24*a*, . . . at downstream sides in the forward feed direction are detected by one mark sensor 25*a* and the timing marks 24*b*, 24*b*, . . . at upstream sides in the forward feed direction are detected by the other mark sensor 25*b*. In this backward feed of web of paper 3, detecting the timing mark 24*b* at the upstream side in the forward feed direction by this other mark sensor 25*b* corresponds to detecting the leading end of one image 23 in the backward feed direction, and detecting the timing mark 24*a* at the upstream side in the forward feed direction by the one mark sensor 25*a* corresponds to detecting the trailing end of one image 23 in the backward feed direction.

Also, the distance of backward travel then of the web of paper 3 for rotary press is detected by the free roll 11 and the encoder 10*c* detecting its rotation and is input into the control unit 9.

From the state that the web of paper 3 for rotary press has been fed to travel backwards over a selected length, the motor M1-M3 are normally actuated to initiate forward re-feed of the web of paper 3, accelerating its speed of travel. In this conjunction, the drive motor M4 is also driven to move the elevating frame 14 to its upper position. And, the web of paper 3 brought back to and stored in the buffer unit 12 is paid out from the buffer unit 12.

Figure 6:
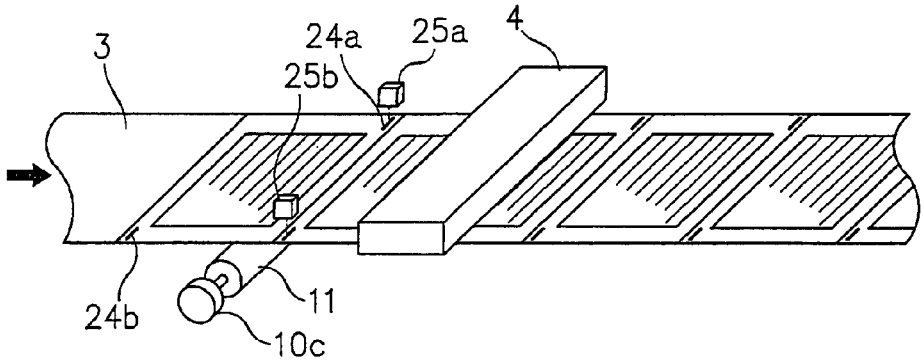
FIG. 6 is a like view illustrating a state that in reinitiating printing, the web of paper is fed to travel forwards.
Figure 7:
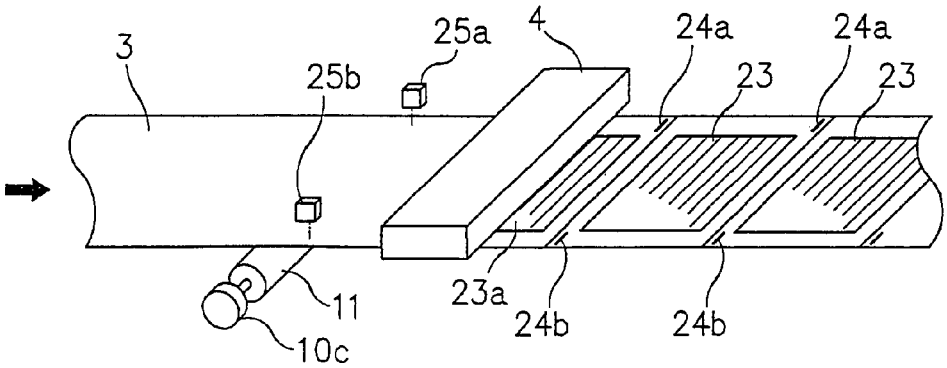
FIG. 7 is a like view illustrating a state that on the web of paper continuing to be fed to travel forwards, printing is reinitiated.

This state is shown in FIG. 6. Then, the number of images 23 re-fed to travel forwards is counted by detecting, and counting the number of, the timing marks 24*a* and 24*b* accompanying the images 23 with the mark sensor 25*a* and 25*b*, the timing marks 24*a* and 24*b* being accompanied with the images 23. Coincidence of this number of counts with the number of counts in the backward feed represents that the last printed image 23*a* has passed over the ink jet printer 4, at this point of time printing of consecutive images starting from an image which follows in position the last printed image 23*a* is initiated. This state is shown in FIG. 7. Then, the timing mark 24*b* at the upstream side in the forward feed direction of the last printed image 23*a* is detected by the other mark sensor 25*b*, thereby noticing that this last image 23*a* passes the mark sensor 25*b*.

Since to initiate printing again, the web of paper 3 for rotary press has a length thereof reserved corresponding to a distance of its travel enough for a necessary time period of acceleration, its traveling speed has reached the predetermined printing speed at the time at which printing is reinitiated.

Also, the distance of travel then of the web of paper 3 is detected by the encoder 10*c* provided for the free roll 11, from signals of which is determined a printing reinitiation position (printing reinitiation timing) at which the number of counts of timing marks 24*a* and 24*b* during the forward travel of paper coincides with the number of counts of timing marks 24*a* and 24*b* during the backward travel of paper to reinitiate printing. This allows printing to be reinitiated precisely from the position immediately following the image 23*a* last printed before suspension of printing.

At the time when printing of an image following the image last printed before the halt is reinitiated, the elevating frame 14 in the buffer unit 12 is moved up to the uppermost position so that the portion of web of paper 3 brought back to and stored in the buffer unit 12 in its backward feed can run out from the buffer unit 12. And, the web of paper 3 that is consecutively fed to travel forwards is fed from the paper feed unit 2 through the buffer unit 12, maintaining an established tension imparted thereto.

Figure 8:
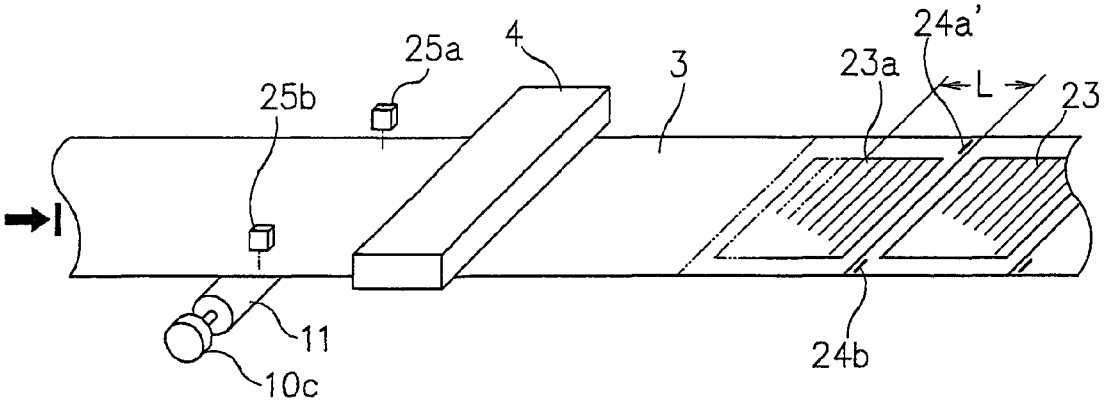
FIG. 8 is a like view illustrating an operation when printing is reinitiated if a last image is partly printed and suspended en route before it is wholly printed.

While in the form of implementation described above, printing by the ink jet printer 4 is suspended where the last image 23*a* has entirely been printed, it should be noted that printing by the ink jet printer 4 may be suspended where a part of the last image 23*a* has been printed and may be reinitiated from the other part of the image 23*a* as shown in FIG. 8 in response to a detection signal by one mark sensor 25*a* for detecting a timing mark 24*a* on the side downstream in the direction of forward travel of the web of paper 3 and a detection signal by the encoder 10*c* for detecting a rotation of the free roll 11.

In this case, referring to FIG. 8, the distance L on the web of paper 3 from a point at which a downstream timing mark 24*a*' for an image 23*a* being last printed when printing is suspended is printed to a point at which printing is suspended is determined by the encoder 10*c* on the basis of a rotation of the free roll 11 from a point of time at which the timing mark 24*a*' for the last printed image 23*a* is printed by the ink jet printer 4 to a point of time at which printing by the ink jet printer 4 is suspended. And, at the point of time when the downstream timing mark 24*a*' for the last printed image 23*a* passing over the inkjet printer 4 is detected by the mark sensor 25, printing of the remaining portion of the last image 23*a* and images following it is reinitiated from a position spaced apart by the distance L from the last printed timing mark 24*a*'. Waste of paper can thus be reduced to zero.

In the form of implementation illustrated, the timing marks 24*a* and 25 associated with each image 23 need not necessarily be printed separately of images 23, if a portion of an image 23 can be detected as a timing mark by the mark sensor 25*a*, 25*b*.

Note also that the mark sensors 25*a* and 25*b* which are arranged to lie upstream of the ink jet printer 4 may be positioned upstream of the paper feed roll unit 6*a* upstream of the ink jet printer 4 or alternatively between the upstream paper feed roll unit 6*a* and the ink jet printer 4.

It should also be noted that while the paper feed roll unit 6*a* and 6*b* in the form of implementation illustrated is shown to use a pair of rolls which are driven by the motors M1 and M2, respectively, and the web of paper 3 is wound thereon in the form of S, they may each be of a single roll type having a single roll driven in rotational contact with a pinch roll.

Further, while the motor M3 used to drive the paper roll shaft of the paper takeup unit 5 can be a servo motor, stepping motor or the like, it may be selected from a variety of ones whose rotation can controllably be switched between normal and reverse.

Also, the digital printer in the present invention is not limited to comprising an ink jet printer but may be constructed of such a printer for digital printing as an electrophotographic printer capable of instantaneously initiating printing on a face immediately following a predetermined printed face.

What is claimed is:

1. A digital printing method using a digital printer by which images each for one page are consecutively printed on a web of paper for rotary press fed to travel forwards, and in which after printing is suspended temporarily en route, printing is reinitiated on the web of paper fed again to travel forwards, characterized in that it comprises the steps of:

printing the images and timing marks each for the image with the digital printer while the web of paper is being fed to travel forwards from a paper feed unit to a paper takeup unit with a pair of paper feed roll units which are positioned upstream and downstream, respectively, of the digital printer in a direction of forward feed of the web of paper and which are made able to feed the web of paper to travel both forwards and backwards;

in reinitiation of printing after printing is temporarily suspended en route, feeding the web of paper to travel backwards so that a series of images and timing marks printed thereon before printing is temporarily suspended moves towards upstream of the digital printer and thereafter feeding the web of paper to travel forwards again, and counting by a mark sensor, upstream of the digital counter, the number of such timing marks moving in each of the backward feed and forward re-feed of the web of paper, respectively;

when the number of counts of the timing marks counted in the forward re-feed coincides with the number of counts of the timing marks counted in the backward feed, reinitiating to print consecutive images from a position following an image last printed before printing is temporarily suspended; and rendering said paper feed unit able to feed the web of paper to travel exclusively forwards while it is being braked, wherein when the web of paper is fed to travel backwards as aforementioned, the web of paper upstream of said upstream side paper feed roll unit is brought back to and stored in a buffer unit having a paper path whose length is made variable.

2. A digital printing method as set forth in claim 1, characterized in that a distance of travel of the web of paper upstream of the digital counter is detected by a travel distance detector, and a position to reinitiate printing when the number of counts of the timing marks counted in the forward re-feed coincides with the number of counts of the timing marks counted in the backward feed, is determined from a detection value by said travel distance detector.

3. A digital printing apparatus for carrying out a digital printing method as set forth in claim 1, characterized in that it comprises:

a digital printer for printing images each for one page consecutively and timing marks each for the image on a web of paper for rotary press fed to travel forwards;

an upstream and a downstream side paper feed roll unit positioned upstream and downstream, respectively, of the digital printer in a direction of forward feed of the web of paper, said paper feed roll units being operable synchronously with each other to feed and to re-feed the web of paper to travel forwards in printing thereon and to feed the web of paper to travel backwards after printing is temporarily suspended;

a paper feed unit positioned upstream of the upstream side paper feed roll unit and adapted to feed the web of paper to travel exclusively forwards while it is being braked;

a paper takeup unit provided downstream of the downstream side paper feed roll unit and adapted to rotate both forwards and backwards in conjunction with operations of both the paper feed roll units;

a buffer unit provided between said paper feed unit and the upstream side paper feed roll unit and in which is brought back to and stored a backward feed length of the web of paper fed to travel backwards from the paper feed roll units after printing is temporarily suspended and from which subsequently in its forward re-feed the length of web of paper so stored is pay out to travel forwards;

a mark sensor positioned upstream of the digital printer in a direction of the forward feed for counting the number of the timing marks in the backward feed after printing is temporarily suspended and counting the number of the timing marks in the subsequent forward re-feed; and a control unit furnished with a number of counts from said mark sensor in the backward feed after printing is temporarily suspended and a number of counts from the mark sensor in the subsequent forward re-feed and operable, when the number of counts of the timing marks counted in the forward re-feed coincides with the number of counts of the timing marks counted in the backward feed, for providing the digital printer with a signal commanding to reinitiate printing consecutive images from a position following an image last printed before printing is suspended.

4. A digital printing apparatus as set forth in claim 3, characterized in that the buffer unit comprises:

a fixed frame provided with an upper roller row having a plurality of guide rollers arranged in a direction of travel of the web of paper, an elevating frame positioned under the fixed frame and capable of being moved up and down, the elevating frame being provided with a lower roller row having a plurality of guide rollers arranged in a direction of travel of the web of paper so as to correspond to those of said upper roller row, and an elevating unit for moving said elevating frame up and down, whereby the elevating frame is moved up and down to change a length of path through which the web of paper is passed between said upper and lower roller row.

5. A digital printing apparatus as set forth in claim 3 or claim 4, characterized in that upstream of the digital printer there is provided a travel distance detector for detecting a distance of travel of the web of paper, the control unit being adapted to receive detection values by the travel distance detector and detection values by said mark sensor for determining from a signal from the travel distance detector a position to reinitiate printing when the number of counts of the timing marks counted in the forward re-feed coincides with the number of counts of the timing marks counted in the backward feed.

* * * * *